United States Patent [19]

Nagase

[11] 4,074,490

[45] Feb. 21, 1978

[54] DECORATIVE WINDOW SASH FRAME ASSEMBLY

[75] Inventor: Mitsuo Nagase, Kurobe, Japan

[73] Assignee: Yoshida Kogyo K. K., Tokyo, Japan

[21] Appl. No.: 762,052

[22] Filed: Jan. 24, 1977

[30] Foreign Application Priority Data

Jan. 23, 1976 Japan ..... 51-7027[U]

[51] Int. Cl.[2] ..... E06B 1/18

[52] U.S. Cl. ..... 52/312; 52/397; 52/716; 52/475; 52/656

[58] Field of Search ..... 52/399, 400, 398, 401, 52/397, 498, 501, 656, 475, 311, 312, 476, 499, 500, 204, 206, 211, 732, 716

[56] References Cited

U.S. PATENT DOCUMENTS

| | | | |
|---|---|---|---|
| 866,479 | 9/1907 | Kiesel | 52/312 |
| 1,589,560 | 6/1926 | Reuter | 52/501 |
| 2,087,516 | 7/1937 | Hunt | 52/500 |
| 3,334,463 | 8/1967 | Muessel | 52/501 |
| 3,638,385 | 2/1972 | Nobels | 52/397 |
| 3,652,380 | 3/1972 | Strack | 52/397 |
| 3,728,833 | 4/1973 | Grossman | 52/311 |
| 3,975,875 | 8/1976 | Goss | 52/211 |
| 3,975,881 | 8/1976 | Ninowski | 52/489 |

*Primary Examiner*—John E. Murtagh

*Attorney, Agent, or Firm*—Hill, Gross, Simpson, Van Santen, Steadman, Chiara & Simpson

[57] ABSTRACT

A decorative window sash frame assembly for peripherally holding a panel member comprises a rectangular frame having a decorative pattern on its interior surface. The frame has a pair of inwardly opening, continuous interior and exterior channel sections formed around the inner periphery of the frame. The interior channel section has a retaining means, and the exterior channel section is adapted to receive the peripheral edge of the panel member. A decorative attachment means extends along the interior channel section and has an engaging means engaging the retaining means to detachably retain the decorative attachment means in position relative to the frame whereby that portion of the decorative attachment means exposed to view gives the window sash a pleasing interior appearance in combination with the decorative pattern on the frame.

3 Claims, 5 Drawing Figures

DECORATIVE WINDOW SASH FRAME ASSEMBLY

BACKGROUND OF THE INVENTION

1. Field of the Invention

This invention relates generally to a window sash and particularly to the decorating of a window sash frame.

2. Prior Art

It is a common practice to employ four frame members each having a decorative pattern, for example, of ridges and recesses on its interior and/or exterior surfaces to give a pleasing appearance to a window sash, the frame members being joined together at their one ends to provide a rigid sash frame. To vary the aesthetic appearance of these window sashes, it is necessary to exchange these conventional decorative frame members entirely, which procedure is expensive.

SUMMARY OF THE INVENTION

Therefore, it is an object of this invention to provide a decorative window sash frame having a decorative means whereby the sash frame can retain a pleasing overall appearance.

Another object is to provide a decorative means for use in combination with window sash frames to provide interior pattern variations in window sashes at low manufacturing costs.

A further object is to provide such a decorative means which can be readily detached for replacement, and is simple and sturdy in construction, and is inexpensive to manufacture.

According to the invention, there is provided a decorative window sash frame assembly for peripherally holding a panel member comprising: a rectangular frame having a decorative pattern on its interior surface, said frame having a pair of inwardly opening, continuous interior and exterior channel sections formed around the inner periphery of said frame, said interior channel section having a retaining means, and the exterior channel section being adapted to receive the peripheral edge of the panel member; and a decorative attachment means extending along the interior channel section, said decorative attachment means having an engaging means engaging said retaining means to detachably retain said decorative attachment means in position relative to said frame.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
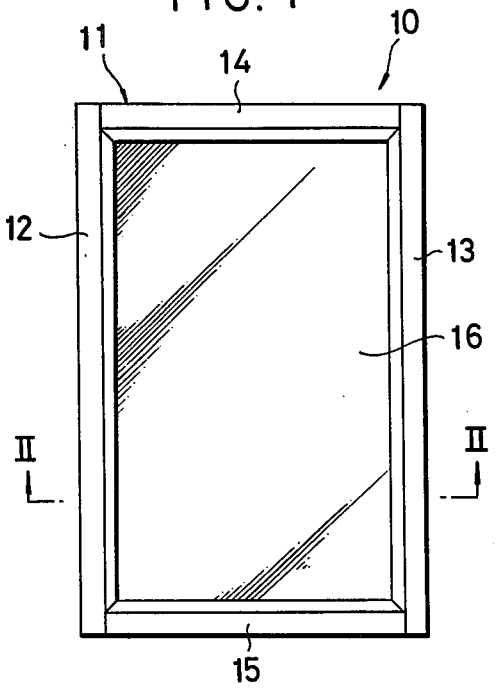
FIG. 1 is a schematic, front elevational view of a window sash having a frame provided in accordance with the present invention.

FIG. 1 shows a window sash 10 which comprises a frame 11 constructed of a pair of spaced upright stiles 12,13 and a pair of spaced top and bottom rails 14,15, the stiles 12,13 and the top and bottom rails 14,15 being made of extruded aluminum and joined together at their one ends to define a rectangular opening in which a glass pane 16 is mounted.

The stile 12 has a hollow body **12*a* of generally square cross-section having a pair of inner and outer side sections 17,18 and a pair of slightly shorter interior and exterior sections 19,20 interconnection the side sections 17,18 adjacent to their respective opposite ends, the interior and exterior sections 19,20 having a pair of identical decorative patterns 21,22 of ridges and recesses formed respectively on their one surfaces facing away from each other. The stile 12 has a pair of opposed flanges 23,24 formed integrally with and extending from the outer side section 18 at its opposite ends, respectively, in a direction away from the inner side section 17. The stile 12 includes a mounting portion 25 having a first channel section 26 receiving the peripheral edge of the glass pane 16, the channel section 26 extending along the length of the inner side section 17. The channel section 26 has a pair of parallel spaced apart arms 27,28 extending from the inner side section 17 in a direction away from the outer side section 18 and a base 29 constituting part of the inner side section 17 and interconnecting the arms 27,28 at their proximal ends. The arm 27 is disposed intermediate the opposite ends of the inner side section 17, and the arm 28 extends from the exterior end of the inner side section 17 remote from the interior section 19. The arms 27,28 have their distal ends 27*a*, 28*a* directed toward each other for gripping engagement with a seal element 30 peripherally embracing the glass pane 16 to hold the same in position within the window sash frame. The mounting portion 25 also has a retaining section 31 which is defined by a retaining web 32 projecting inwardly from the inner side section 17 at its interior end in parallel relationship to the arm 27, the arm 27, and that portion 33 of the inner side section 17 lying between the web 32 and the arm 27, the web 32 extending along the entire length of the inner side section 17. The retaining web 32 has its distal end portion 34 directed toward the arm 27 in parallel relationship to the inner side section 17. The arm 27 has an integral longitudinal ridge 35 directed toward and disposed in registry with the web end portion 34 and extending along the entire length of the arm 27 to define a second channel section 36 of a smaller configuration together with the retaining web 32, that portion 33 of the inner side section 17 and that portion of the arm 27 lying between the inner side section 17 and the longitudinal ridge 35**.

Figure 2:
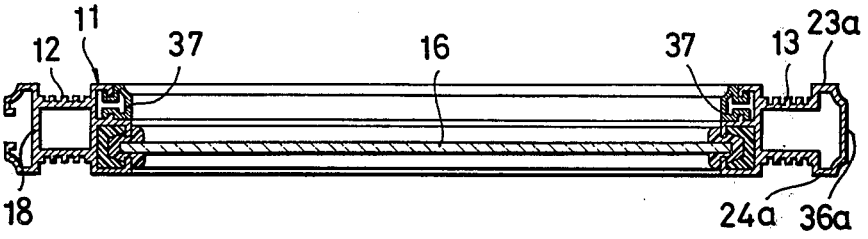
FIG. 2 is a vertical cross-sectional view taken along line II—II of FIG. 1.

As shown in FIG. 2, the stile 13 has generally the same configuration as the stile 12 and only differs in that it does not have a portion corresponding to the outer side section 18 of the stile 12 and that it has a connecting web **36*a* interconnecting a pair of flanges 23*a*,24*a***.

Each of the top and bottom rails 14,15 has a mounting portion (not shown) identical to that of each of the stiles 12,13, and when these four frame members 12,13,14,15 are joined together at their one ends to provide the frame 11, the first and second channel sections 26,36 of these four frame members jointly provide a pair of continuous peripheral channels.

According to an important aspect of this invention, a decorative means is provided for improving the interior appearance of the window sash 10, the decorative means comprising a pair of attachment members 37,37 adapted to be attached to the stiles 12,13 respectively, and another pair of shorter attachment members of identical cross section (not shown) adapted to be secured to the top and bottom rails 14,15, respectively.

Figure 3:
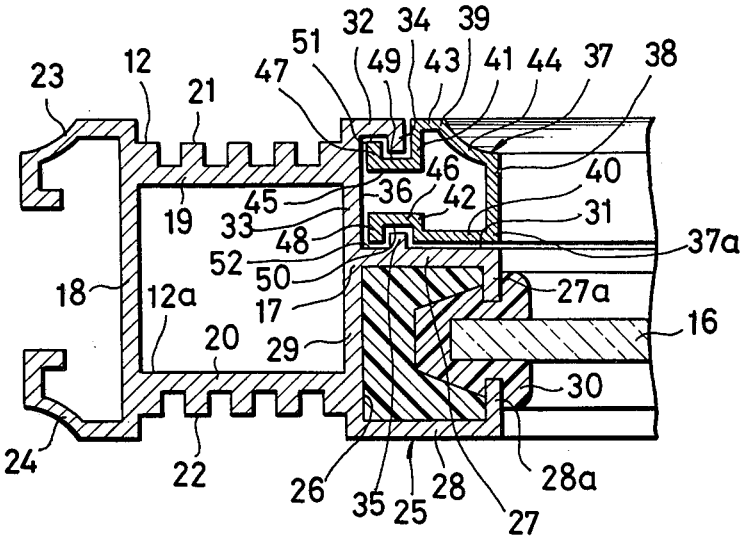
FIG. 3 is a fragmentary cross-sectional view of the window sash on an enlarged scale, best showing a decorative attachment member mounted in its operative position.

As best shown in FIG. 3, the decorative attachment member 37 made of extruded aluminum includes a hollow body 37*a* of a generally outwardly opening channel-like shaped cross-section having a base 38 and a pair of arms 39,40 having their distal end portions 41,42 directed toward and disposed in registry with each other, the base 38 extending at a right angle to the arm 40, and the distal end portions 41,42 extending in parallel relationship to the base 38. The arm 39 has a straight portion 43 extending right-angularly from the end portion 41 and a decorative concave arcuate portion 44 lying between the straight portion 43 and the base 38. The decorative attachment member 37 has a pair of parallel spaced legs 45,46 extending right-angularly from the end portions 41,42, respectively, in a direction away from the base 38, the legs 45,46 having their end portions 47,48 directed away from each other to define together with the end portions 41,42 a pair of oppositely opening longitudinal recesses 49,50.

The decorative attachment member 37 is secured to and retained in place by the retaining section 31, with the oppositely directed end portions 47,48 respectively received in a pair of opposed grooves 51,52 of the second channel section 36, and with the end portion 34 and the longitudinal ridge 35 received respectively in the pair of oppositely opening recesses 49,50. The distance between the web end portion 34 and the ridge 35 is slightly greater than that between the pair of spaced legs 45,46. The interior surface of the straight portion 43 lies substantially flush with that of the retaining web 32, and the arm 40 is disposed in parallel contiguous relationship to the arm 27. The inner surface of the base 38 lies substantially flush with that of the end portion 27*a* of the arm 27. That portion of the decorative attachment member 37 exposed to view, that is, the base 38 and the arm 39 gives the window sash 10 a pleasing interior appearance in combination with the decorative pattern 21 of ridges and recesses formed on the interior section 19.

For assembling the window sash 10, the decorative attachment member 37 is first attached to the retaining section 31 in such a manner that the pair of legs 45,46 are inserted into the second channel section 36 from one end thereof and moved slidingly along the length thereof to its operative position, with the end portions 47,48 received respectively in the grooves 51,52 and with the web end portion 34 and the ridge 35 received respectively in the recesses 49,50. Similarly, the respective decorative attachment members are attached to the stile 13 and the top and bottom rails 14,15. Then, the stiles 12,13 and the top and bottom rails 14,15 are joined together at their one ends to provide the frame 10 for peripherally holding the glass pane 16 in place through the sealing element 30, and finally, the joined ends of these four frame members 12,13,14,15 are fixedly secured to one another by a suitable fastening means such as screws to provide the window sash 10.

Figure 4:
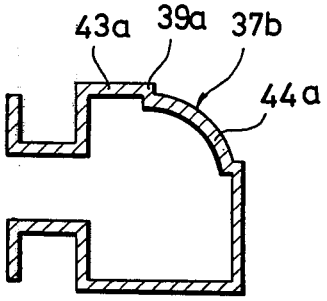
FIGS. 4 and 5 are cross-sectional views of modified decorative attachment members.

According to a modified form of decorative attachment member 37*b* shown in FIG. 4, an arm 39*a* has a straight portion 43*a* and an offset decorative convex arcuate portion 44*a*.

Figure 5:
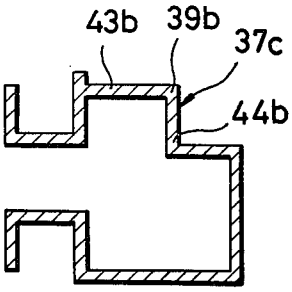

FIG. 5 shows a further modified form of decorative attachment member 37*c* in which an arm has a straight portion 43*b* and a decorative angle portion 44*b*. The decorative attachment member can be modified to have any interior design.

With the construction, the window sash can retain a variety of pleasing interior appearances simply by exchanging the various attachment members in an inexpensive manner.

The terms "inner and outer" used above are used with reference to the geometric center of the window sash. The words "interior and exterior" used above are used with reference to the geometric center of a building, usually indoors and outdoors respectively.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A window sash frame assembly for peripherally holding a panel member comprising: a rectangular frame having a raised decorative pattern on its interior surface, said frame having a pair of inwardly opening, continuous interior and exterior channel sections formed around the inner periphery of said frame and defining spaced channels, said interior channel section having a retaining means, and said exterior channel section being adapted to receive and hold the peripheral edge of the panel member at both sides thereof in one of said channels; and a decorative attachment means extending along the interior channel section and disposed in part only in the other of said channels, said decorative attachment means having an engagement means engaging said retaining means to detachably retain said decorative attachment means in spaced relation relative to said one channel.

2. A decorative window sash frame assembly according to claim 1, in which said frame includes a body of generally square cross-section having a pair of inner and outer sections and a pair of interior and exterior sections interconnecting said inner and outer sections at their respective opposite ends and integral therewith, said inner section having a pair of parallel spaced apart interior and exterior arms extending inwardly to define said one channel, said interior arm being disposed intermediate the opposite ends of said inner section, said exterior arm being disposed at exterior end of said inner section, said inner section also having a longitudinal web extending inwardly from the interior end of said inner section to define together with said interior arm said other channel, said web having its distal end directed exteriorly, said interior arm having a longitudinal ridge directed toward and disposed in registry with said web distal end for coacting therewith, and said web distal end and said longitudinal ridge defining said retaining means.

3. A decorative window sash frame assembly according to claim 2, in which said decorative attachment means includes a body of generally outwardly opening channel-shaped cross section having a pair of spaced apart arms and a base extending therebetween, said attachment means having a pair of oppositely opening recess portions extending outwardly from said arms, respectively, said recesses defining said engaging means, and said web distal end and said longitudinal ridge being disposed in said recesses, respectively.

* * * * *